United States Patent [19]

Skovajsa

[11] Patent Number: 4,678,183

[45] Date of Patent: Jul. 7, 1987

[54] DEVICE FOR SKI TRAINING

[76] Inventor: Joseph Skovajsa, 19, Avenue Vauquelin, 93470 Coubron, France

[21] Appl. No.: 784,848

[22] Filed: Oct. 4, 1985

[30] Foreign Application Priority Data

Oct. 10, 1984 [FR] France ..... 84 15543

[51] Int. Cl.[4] ..... A63B 69/18

[52] U.S. Cl. ..... 272/97; 434/253

[58] Field of Search ..... 272/97; 434/253

[56] References Cited

U.S. PATENT DOCUMENTS

| | | | |
|---|---|---|---|
| 2,964,315 | 12/1960 | Dinning | 272/97 |
| 3,207,510 | 9/1965 | Gibson | 272/97 |
| 3,374,782 | 3/1968 | Izzo | 272/97 X |
| 3,582,066 | 6/1971 | Keryluk | 272/97 |
| 3,707,283 | 12/1972 | Cormier | 272/97 |
| 4,101,136 | 7/1978 | Corll | 272/97 |
| 4,396,189 | 8/1983 | Jenkins | 272/97 |

FOREIGN PATENT DOCUMENTS

| | | |
|---|---|---|
| 2503728 | 12/1976 | Fed. Rep. of Germany . |
| 2245387 | 8/1973 | France . |

*Primary Examiner*—William H. Grieb

*Attorney, Agent, or Firm*—Fiddler and Levine

[57] ABSTRACT

The present invention relates to a ski training device which comprises a generally horizontal support plate, oscillating about a principal axis of symmetry, and two sole plates on which rest the feet of a user, carried pivotally on the support plate respectively on one side and the other of a plane of symmetry passing through the principal pivoting axis of the support plate, about respective auxiliary axes generally perpendicular to the upper surface of the support plate. Alternating pivotings of the sole plates about their respective axes, induced by the user, are accompanied by an alternating rocking of the support plate about the associated principal axis.

18 Claims, 19 Drawing Figures

DEVICE FOR SKI TRAINING

Figure 1:
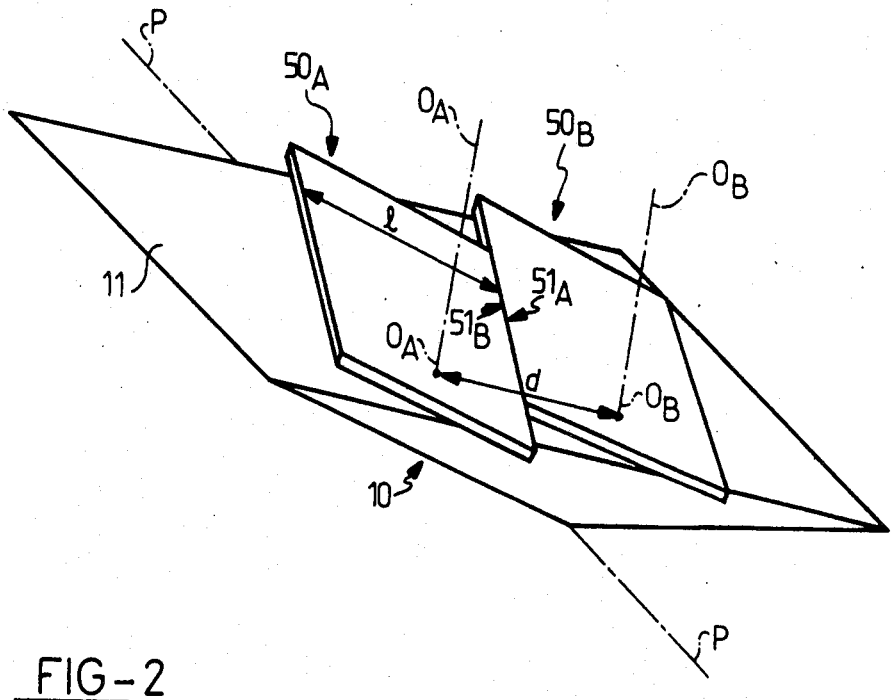

The present invention relates to a training device for skiing.

The training device of the present invention permits on the one hand physical exercise improving the stamina of the skier as well as his suppleness, and on the other hand a simulation of the movements of a skier on a skiing piste.

Numerous ski training devices have already been proposed.

French patent application published under No. 2 245 387 describes for example an apparatus comprising a movable plate on which the user stands, displaceable on a fixed base between between two end positions determined by abutments, and urged towards a rest position by a return spring.

The French patent application published under No. 2 350 857 describes an apparatus having two parallel boards adapted to undergo a downward movement against the action of elastic means, as well as a pivoting movement about a horizontal median axis on the support itself pivoted about an axis normal to the axes of articulation of the boards and substantially vertical. Preferably, the inclination of the base to the horizontal is in addition adjustable.

The French patent application published under the No. 2 067 398 describes a ski training device having two carriages simulating the skis, movable on an inclined plane resting on the ground. More precisely, each of the carriages is able to be driven by two independent movements, the one in rotation parallel to the inclined plane, about a fixed axis perpendicular to the inclined plane, the other of variable inclination with respect to the inclined plane, by rotation about an axis parallel to the said inclined plane.

The French patent application published under the No. 2 292 494 relates to a ski training apparatus comprising two oscillating and sliding foot rests.

The French patent application published under the No. 2 155 709 describes a ski training apparatus comprising two skis mounted on pivots and displacable via rollers on a base provided with embossing.

Other ski training devices are described and shown in 5 the French patent applications published under the Nos. 2 023 169, 2 262 362, 2 336 150, 2 410 486, 2 521 435, 2 347 946, 2 403 091 and 2 523 856.

All these prior devices turn out to be costly and unreliable. Further, these prior devices do not permit simulating in a simple manner the movements of skiing, at least for a beginner.

The problem to be resolved is then to propose a ski training device, at once simple, economic and robust, which permits on the one hand efficient physical training and on the other hand a simple and automatic simulation of the movements of the skier.

The problem thus posed is resolved according to the invention by a training device which comprises:

a generally horizontal support plate, oscillating about a longitudinal and generally horizontal principal axis of symmetry and, two sole plates on which rest the feet of a user, carried pivotally on the support plate, respectively on one side and the other of a plane of symmetry passing through the principal pivoting axis of the plate about respective generally parallel auxiliary axes perpendicular to the upper surface of the support plate, so that alternating pivoting of the sole plates about their respective auxiliary axes, brought about by the user, is accompanied by an alternating rocking of the support plate about the associated principal axis.

Thus, the alternating pivoting of the sole plates about their respective auxiliary axes and the alternating rocking of the support plate about the associated principal axis are necessarily synchronised which imposes on the user a position corresponding precisely to the position of the skier.

The utilization of the ski training device according to the present invention thus permits avoidance in safety of becoming accustomed to an erroneous position.

The alternating rocking of the support plate about the associated principal axis is achieved on alternating pivotings of the sole plates about their respective axes, brought about by the user, when the point of application of the weight of the user on the support plate.-crosses a vertical plane passsing, through the principal axis associated with pivoting of the support plate.

For this, the auxiliary axes are advantageously longitudinally eccentric of the respective sole plates. More precisely, preferably, the auxiliary axes are provided in the region of the front end of the sole plates.

According to an advantageous characteristic of the invention, the auxiliary axes are situated at mid-width of the respective associated sole plates and the width of each sole plate is slightly less than the distance separating the auxiliary axes.

Thus, the end positions of the sole plates are defined by reciprocal abutment of the sole plates, which avoids the installation of additional abutments on the support plate and thus permits a particularly simple embodiment of the device.

Preferably, each sole plate is provided with a shoe. This arrangement permits an assistance of positioning.

In an advantageous manner, each sole plate is fixed on the support plate by elastic engagement of a pivot pin rigid with the sole plate, in a complementary bore in the support plate. Thus, no auxiliary fixing device is necessary.

According to a first variant, the support plate is formed of a body of which the upper face is plane and the lower face is composed of two relatively inclined planes, delimiting a principal longitudinal pivot bearing in the vicinity of their junction.

According to a second variant, the support plate comprises an upper web generally plane supported by transverse ribs having two relatively inclined edges, which delimit a principal longitudinal pivot bearing in the vicinity of their junction.

In order to limit the contact area between the sole plates and the support plate, each sole plate advantageously comprises a generally plane body of which the lower surface is provided with several protrusions intended to slide on the support plate on alternating pivoting of the sole plates.

In a preferential manner, the support plate is made of thermo-plastics material, such as polyacetal, and preferably at least partially with the aid of a molybdenum based polyacetal.

According to an advantageous characteristic of the invention, the angular oscillating displacement of the support plate is between 5° and 20°, and preferably in the region of 10°.

According to another characteristic of the invention, the angular displacement of each sole plate is between 30° and 80° and preferably is substantially equal to 55° .

According to a judicious embodiment, the pivot bearing of the support plate can be formed of a ridge, with a thin cross section parallel to the upper surface of the plate, or again a convex rounded surface.

Figure 2:
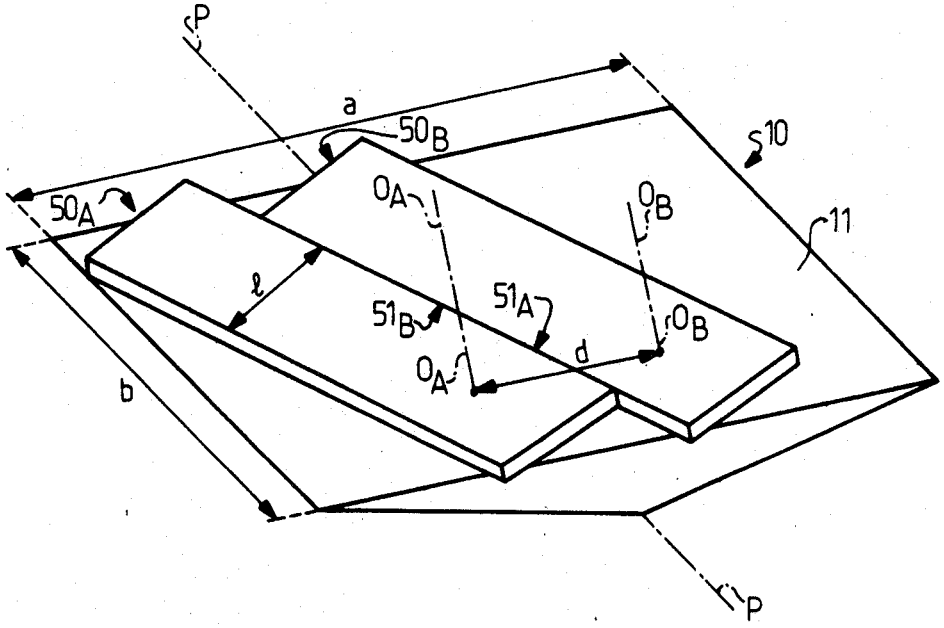
Figure 3:
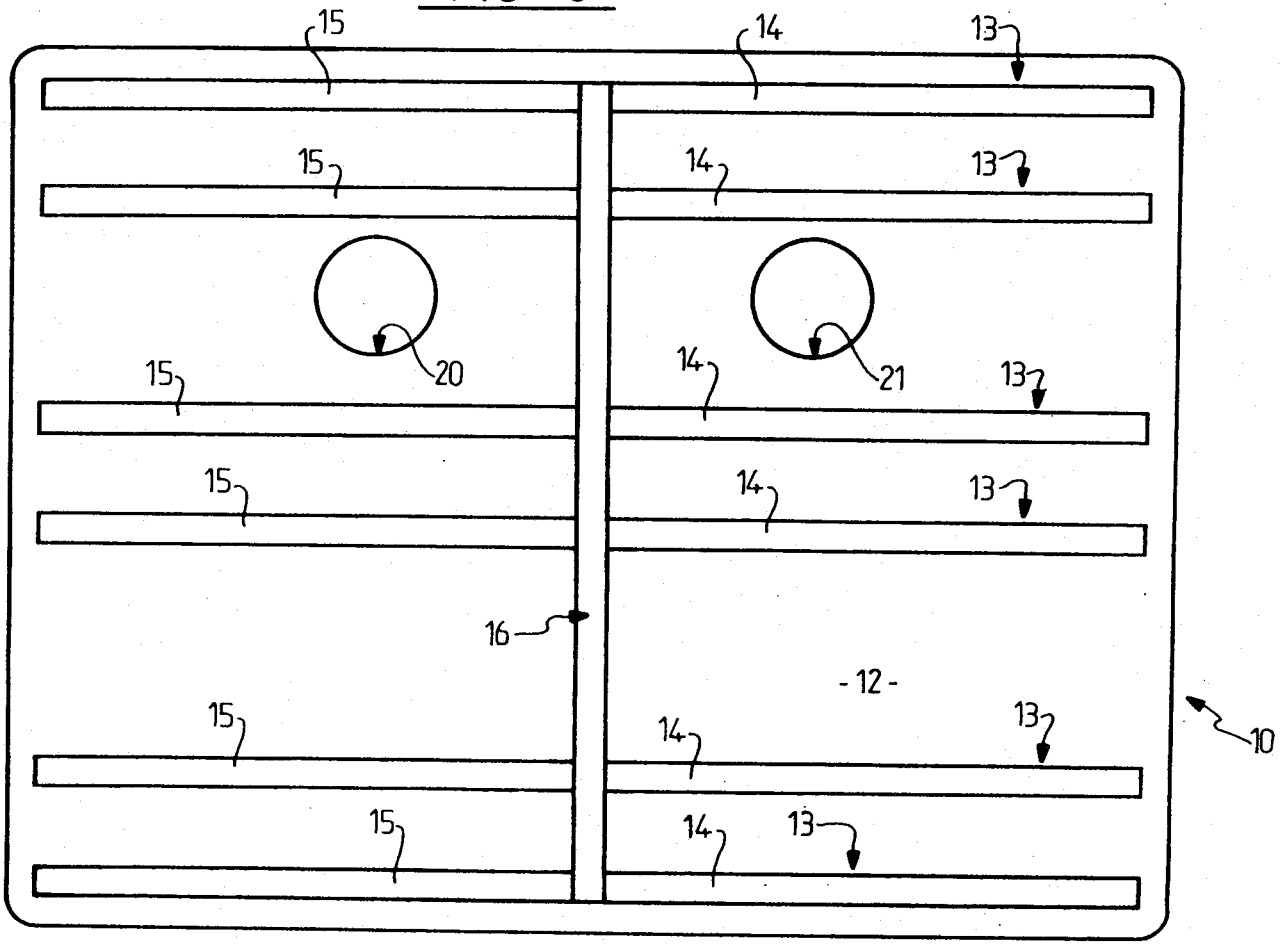
Figures 4A, 4B, 4C:
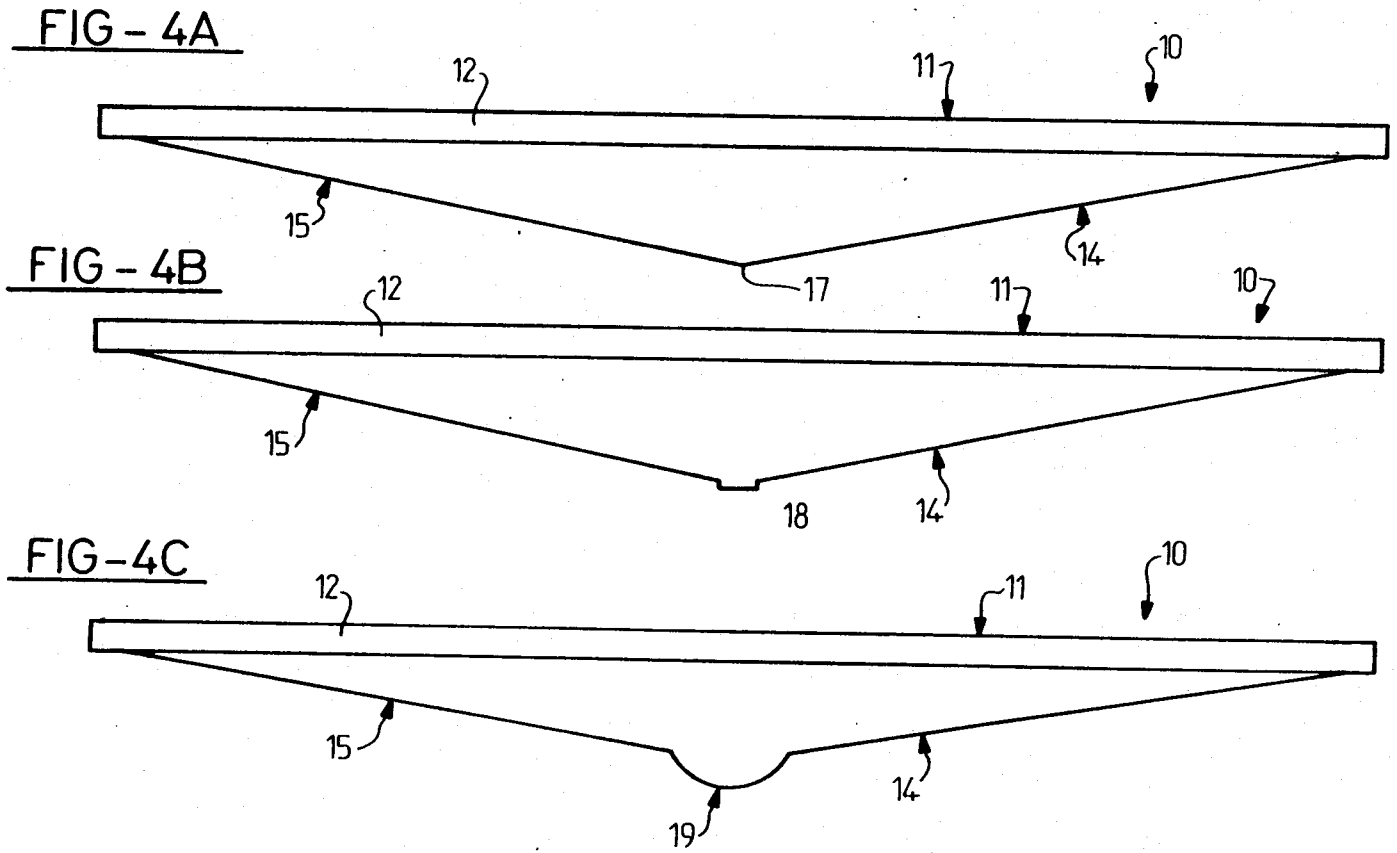
Figure 6:
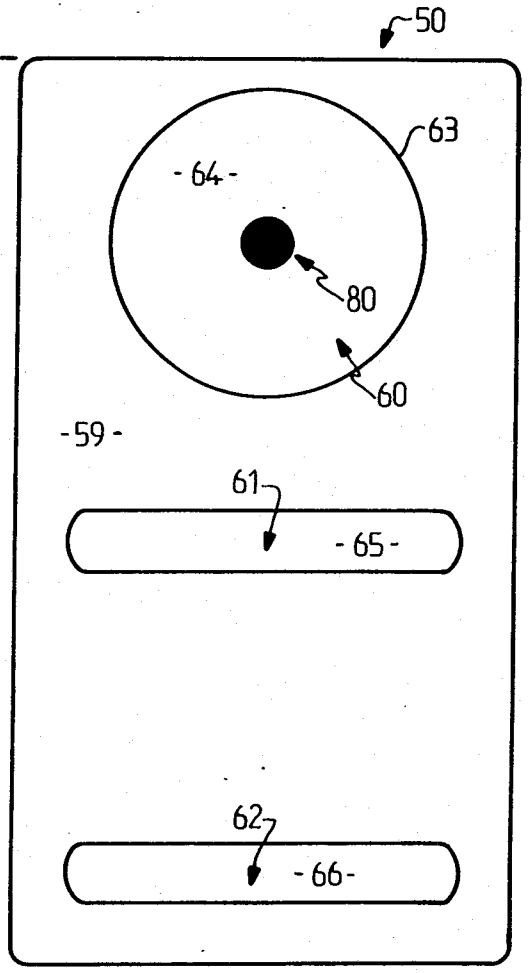
Figure 5:
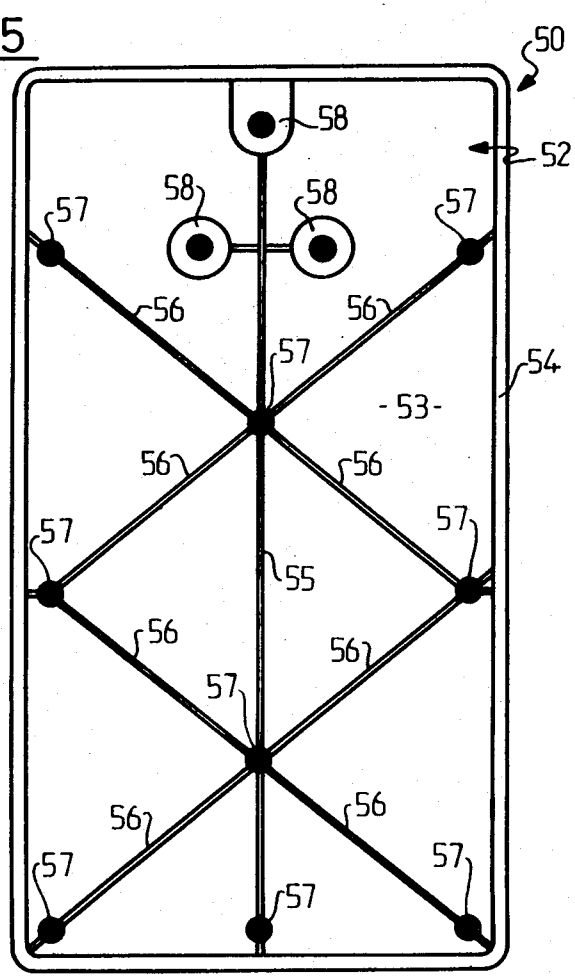
Figure 7:
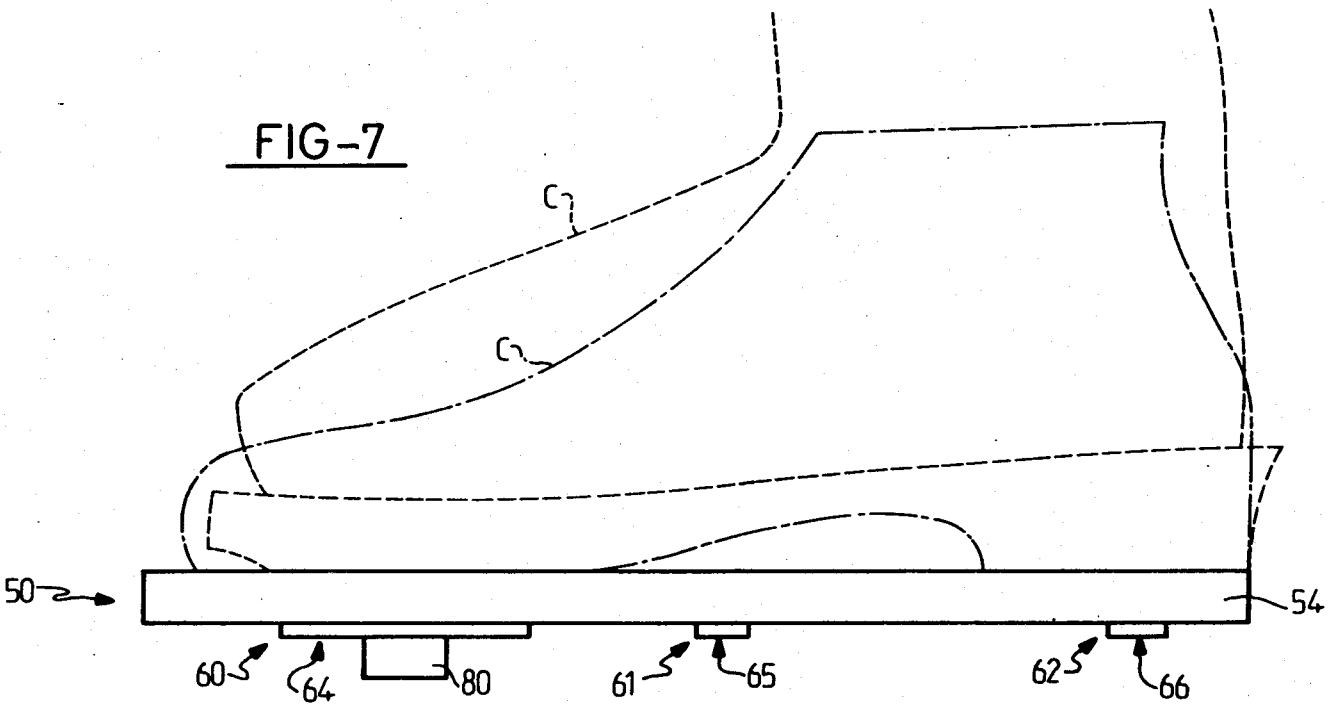
Figure 8:
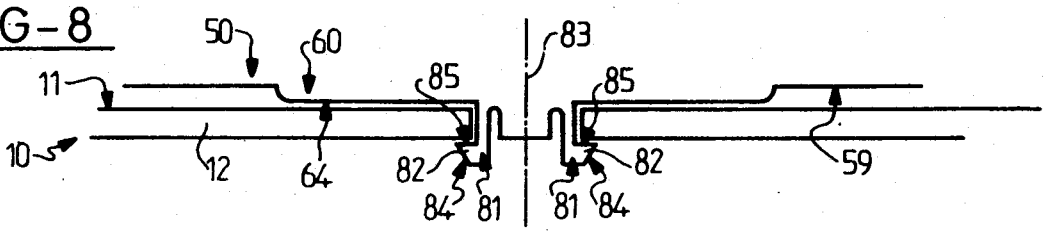
Figure 9:
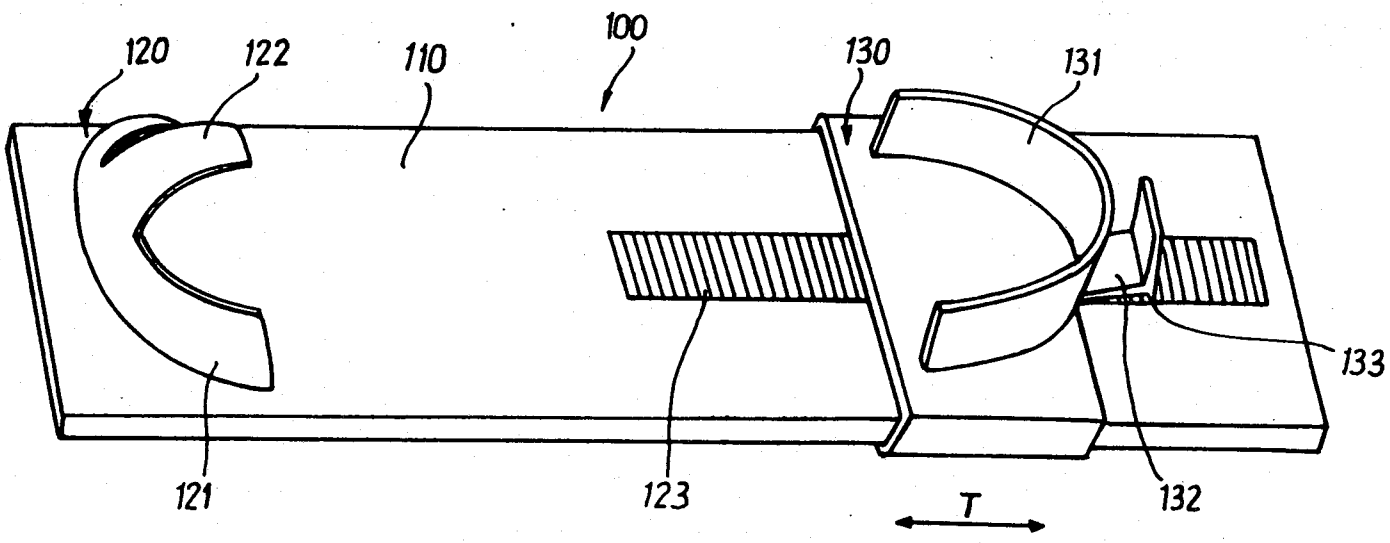
Figure 10:
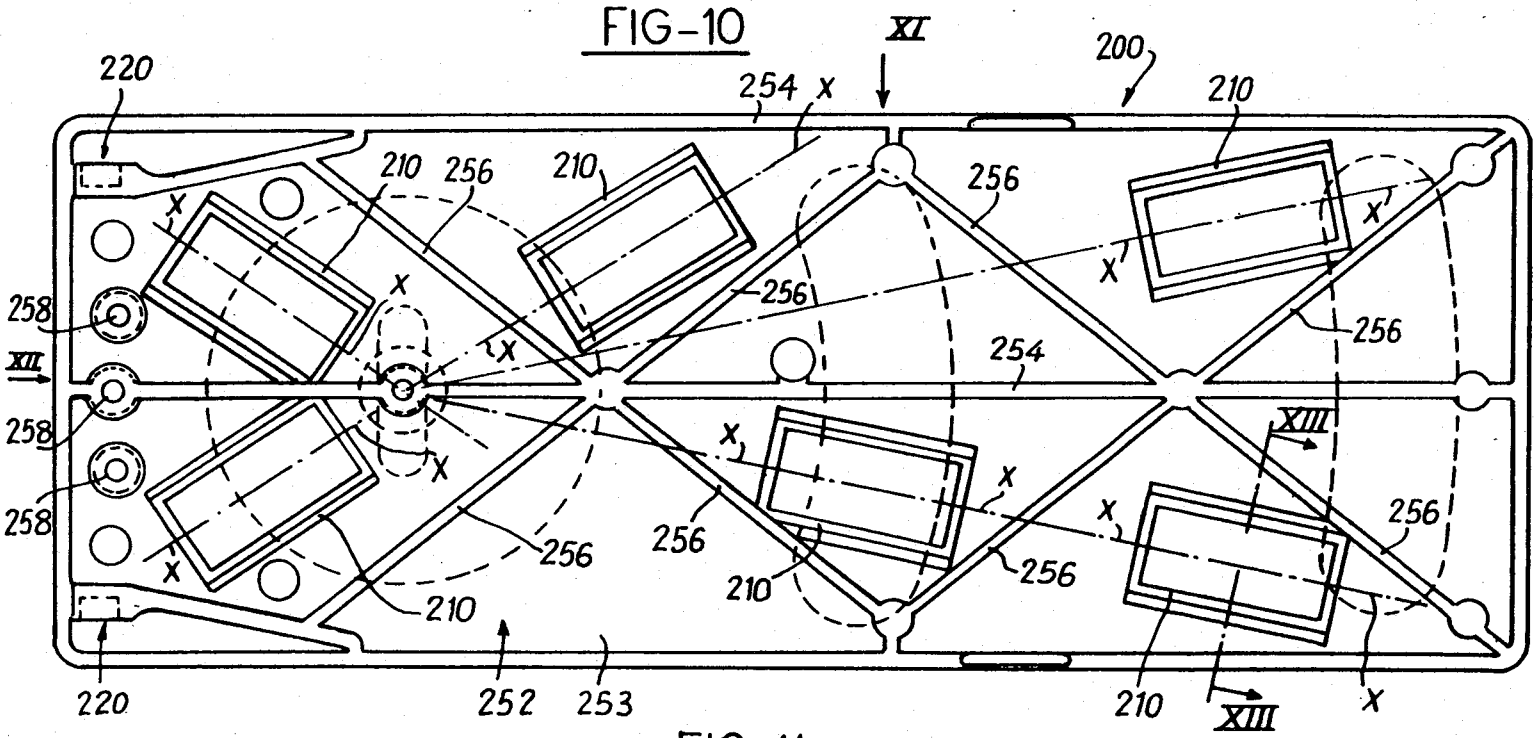
Figure 11:
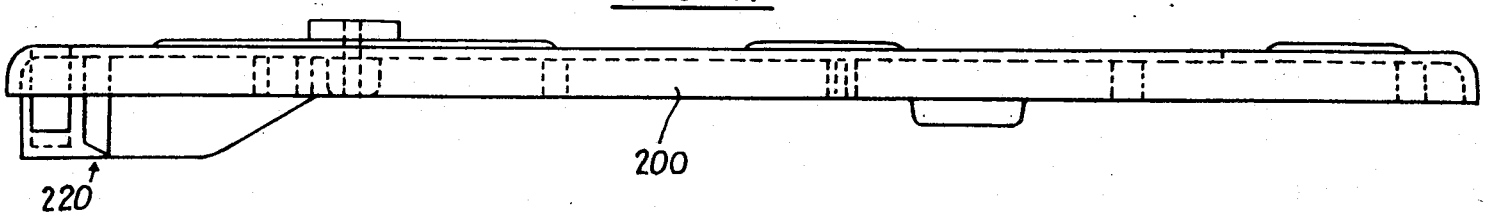
Figure 12:
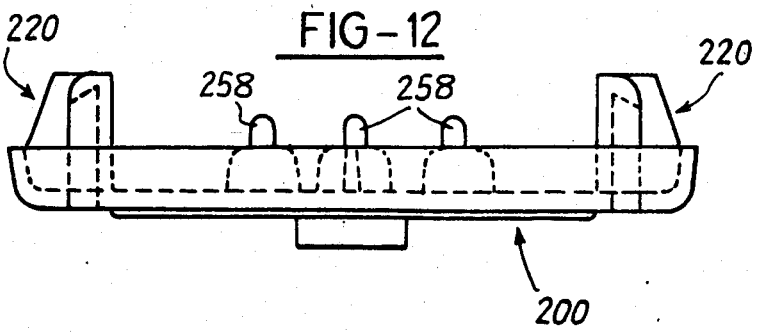
Figure 13:
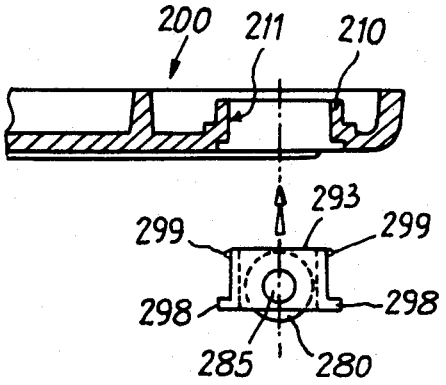
Figure 14:
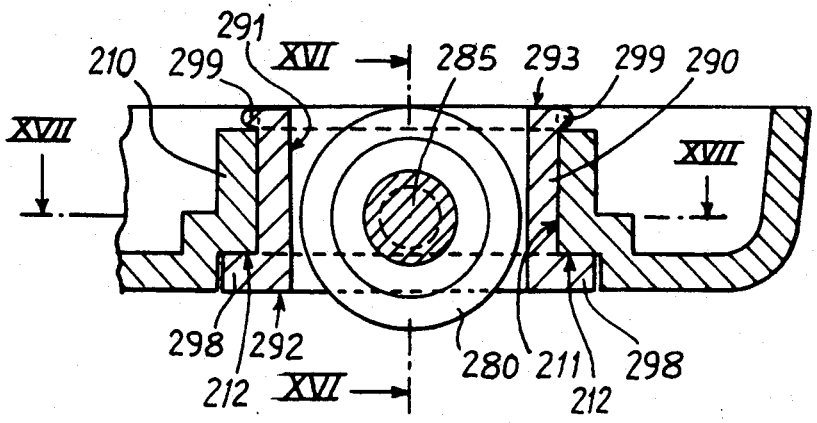
Figure 15:
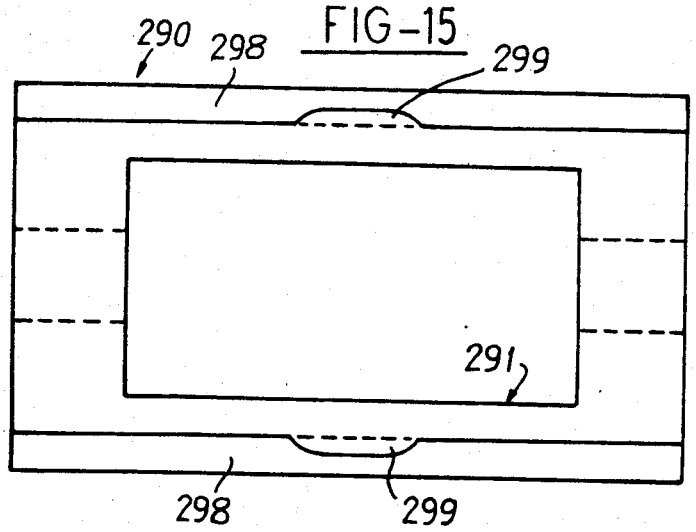
Figure 16:
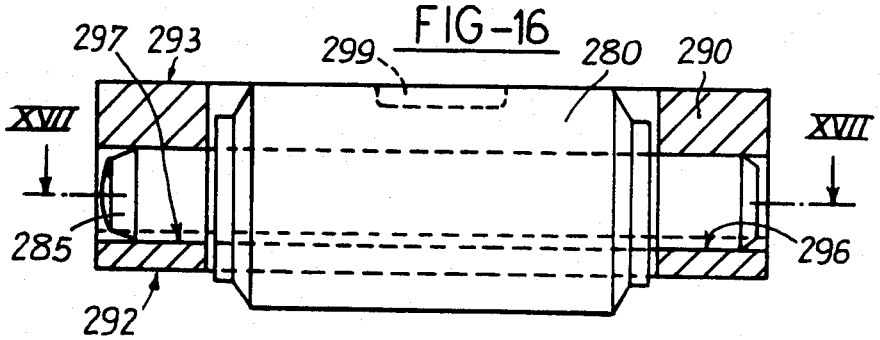
Figure 17:
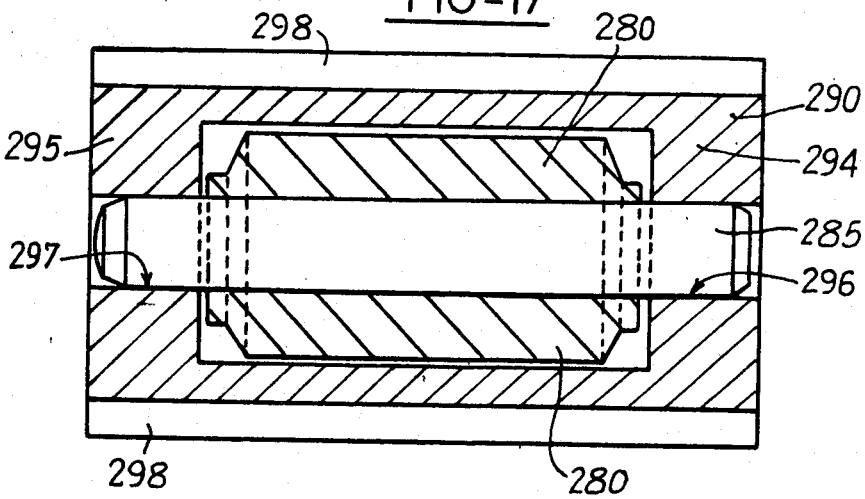

Other characteristics and advantages of the present invention will appear from reading the following detailed description with reference to the accompanying drawings given by way of non-limitative examples and in which:

FIG. 1 shows a schematic perspective view of a ski training device of the present invention in a first rocking position of the support plate and of the sole plates, FIG. 2 shows a schematic perspective view of the same ski training device in a second rocking position of the support plate and of the sole plates, FIG. 3 shows an underneath view of a support plate used in a ski training device according to the present invention, FIGS. 4A, 4B and 4C show, in a front view, three variants of a support plate used in a ski training device according to the present invention, FIG. 5 shows an underneath view of a sole plate used in a ski training device according to the present invention, FIG. 6 shows an underneath view of a sole plate used in a ski training device according to the present invention, FIG. 7 shows a schematic side view of a sole plate equipped with a shoe, used in a ski training device according to the present invention, FIG. 8 illustrates a fixing detail for a sole plate on the support plate of a ski training device according to the present invention, FIG. 9 represents a schematic perspective view of a device permitting fixing of any type of known shoe on the pivoting sole plates of the device, FIG. 10 represents a schematic view from below of a variant of pivoting sole plates, FIGS. 11 and 12 represent two views of the same sole plates according to laterial orthogonal views illustrated by the reference arrows XI and XII in FIG. 10, FIG. 13 illustrates schematically the assembly of rollers on the mentioned sole plates, according to a cross-section referenced XIII—XIII in FIG. 10, FIG. 14 represents a schematic view in partial cross-section according to an identical section plane XIII—XIII of the same sole plate equipped with rollers, FIG. 15 represents a view from below of a removable support cage for the rollers, FIG. 16 shows a schematic view in vertical section of the support cage for the rollers according to a section plane referenced XVI—XVI in FIG. 14, and FIG. 17 represents a schematic view in horizontal section of the same support cage for the rollers according to a section plane referenced XVII—XVII in FIGS. 14 and 16.

In a general manner, as is illustrated in FIG. 1, the ski training device according to the present invention comprises a support plate 10 and two sole plates 50A,50B.

As appears on comparative examination of FIGS. 1 and 2, the support plate 10, which extends generally horizontally and of which the upper surface 11 is flat, is oscillating about a generally horizontal principal axis of longitudinal symmetry referenced P—P in the Figures.

The sole plates 50A and 50B which each have the general form of a flat elongate plate are carried pivotally on the support plate 10, respectively on one side and the other of a plane perpendicular to the upper surface 11 of the support plate and passing through the said axis P—P, about respective auxiliary axes parallel to each other and perpendicular to the upper surface 11 of the support plate 10. These auxiliary axes are referenced OA and OB in the Figures.

These axes OA and OB are symmetric with respect to the said plane perpendicular to the upper surface 11 of the support plate 10 and passing through the pivot axis P—P.

The thickness of the sole plates referenced 1 in FIGS. 1 and 2 is slightly less than the distance referenced d in FIGS. 1 and 2 separating the auxiliary axes OA and OB.

Thus, when the sole plates 50A and 50B extend generally parallel to the principal axis P—P, the training device is in perfect equilibrium, and a regular space exists between the adjacent longitudinal edges 51A and 51B of the sole plates.

On the contrary, if a user standing on the sole plates induces an inclination of these with respect to the axis P—P, as shown in FIGS. 1 or 2, the support plate 10 rocks in synchronism, in an alternating manner, about the associated principal axis P—P.

According to a preferential embodiment shown in FIG. 3, the support plate 10 comprises an upper web 12 generally flat supported by transverse parallel ribs 13 each having two edges 14,15 relatively inclined (as appears in FIGS. 4A to 4C which will be described below) and delimiting a principal longitudinal pivot bearing in the vicinity of their junction.

More precisely, according to the embodiment shown in FIG. 3, the lower surface of the web 12 is provided with a longitudinal median rib 16, perpendicular to the mentioned ribs 13. As appears from examination of FIG. 3, the longitudinal rib 16 is connected to the transverse ribs 13 in the region of junction zones of the inclined edges 14 and 15.

According to a first variant illustrated in FIG. 4A, the lower surface of the longitudinal rib 16 can present a ridge 17 coinciding with the principal axis P—P and forming the pivot bearing for the support plate 10.

According to another variant, actually considered to be preferential, and particularly illustrated in FIGS. 3 and 4B, the lower surface of the longitudinal rib 16 delimits a plane generally parallel to the upper surface 11 of the support plate and forming a pivot bearing for it. In such a case, when the training device according to the present invention is used on a perfectly rigid support surface, the principal pivot axis is doubled in the form of two secondary axes at the parallel edges of the said plane 18.

According to another variant illustrated in FIG. 4C, the lower surface of the longitudinal rib 16 is delimited by a rounded convex surface 19, for example in the form of a sector of a circular cylinder. In such a case, the principal pivot axis P—P is at the centre of curvature of the rounded convex surface 19.

It should be noted that, means permitting the oscillations of the support plate 10 between the two positions shown in FIGS. 1 and 2, as well as the structure of the support plate 10 are susceptible of numerous variations.

By way of example, the support plate can be formed of a body of which the upper surface is flat and the lower surface is composed of two flats relatively inclined, delimiting a principal longitudinal pivot bearing at their junction.

According to a variant, the support plate can be formed from a flat base pivotally mounted via the intermediary of pivot pins or functionally equivalent means on a fixed chassis.

The upper web 12 of the support plate 10 is provided, between two adjacent transverse ribs 13, with orifices 20,21 having axes perpendicular to the upper surface 11 and symmetric with respect to the mentioned plane normal to the support surface 11 and passing through the principal axis PP. These bores 20,21 respectively receive for pivoting the sole plates 50A and 50B.

According to a preferential embodiment shown in the Figures, in particular in FIGS. 5,6,7 and 8, each sole plate 50 is formed of a flat body 52 of rectangular contour having on its upper surface 53 strengthening ribs 54,55 and 56, and on its lower surface 59 protrusions 60,61 and 62 resting on the upper surface 11 of the support plate 10.

More precisely, according to the embodiment shown in FIG. 5, the upper surface 53 of each sole plate 50 comprises a rib 54 of rectangular contour arranged at the periphery of the body 52 and forming a rim, a longitudinal median rib 55 and a plurality of ribs 56 inclined with respect to the longitudinal median rib 55 and connecting it to the longitudinal sections of the rim 54.

The different ribs 54,55 and 56 are reinforced in the vicinity of their respective junction zones by plugs 57.

In addition, one will note in FIG. 5 the presence of plugs 58 on the upper surface 53 of the body 52. These plugs 58 are advantageously utilized for the fixing of a shoe or a shoe support such as referenced schematically in broken lines, under the reference C in FIG. 7.

By way of non-limitative example, fixtures of the bottom of a ski shoe can thus be anchored on the mentioned plugs 58.

In addition, one notices from examining FIG. 6, a first protrusion 60 arranged in the region of the front of the sole plates 50, of circular contour 63, and of which the top 64 is formed of the plane parallel to the surfaces 53 and 59.

This protrusion 60 surrounds a pivot pin 80 with which it is coaxial, intended to penetrate into one of the mentioned bores 20,21, and of which the structure will be brought out in more detail by.the following with respect particularly to FIG. 8.

One notices in addition from examination of FIGS. 6 and 7, on the lower surface 59 of the sole plates 50 two protrusions 61,62 generally rectilinear and parallel, extending transversely to the mentioned longitudinal rib 55 and of which the tops 65,66 are formed of planes generally parallel to the surfaces 53,59 previously mentioned.

The man skilled in the art will easily appreciate that the protrusions 60,61 and 62 thus described have the object of limiting the contact surface area between the sole plates 50 and the support plate 10 in order to reduce friction between these elements.

Preferably, as shown in FIG. 8, the pivot pin 80, of a generally cylindrical envelope projecting on the lower surface 59 of the sole plates 50, is formed of a plurality of fins 81 separated and slightly elastic, provided with tapers 82 projecting outwards of the pivot pin 80 transversely to the axis 83 of it.

As appears from examination of FIG. 8, the transverse section of the body of the pin 80 (considered parallel to the surfaces 53 and 59) is slightly less than the internal diameter of the bores 20,21, whilst the transverse section of the pivot pin 80, considered in the vicinity of the tapers 82 is slightly greater than the internal diameter of the bores 20,21.

Thus, the engagement of a pivot pin 80 in one of the bores 20,21 is achieved by elastic deformation of the fins 81, which elastically take up again their rest position, when the tapers 82 are passed through the web 12 of the support plate 10.

Preferably, as is shown in FIG. 8, each taper 82 has an engagement edge 84 which converges in the direction of the axis 83 extending from the lower surface 59, for facilitating the engagement of the pivot pin 80 in one of the bores 20,21, as well as an abutment surface 85 parallel to the surface 59, and intended to rest against the lower surface of the web 12 after elastic engagement of the pivot pin 80 in one of the bores 20,21, for immobilising a sole plate 50 on the support plate 10.

It should be noted that the structure of the pivot pin 80 which has been described is able to replaced by any means functionally equivalent.

By way of example, the sole plates 50 can be retained pivotally on the support plate 10 thanks to threaded means (associated if necessary with a washer) engaging in a cylindrical pivot pin 80 rigid with the sole plates 50 and engaged in one of the bores 20,21.

In an advantageous manner, the ski training device according to the invention is made in thermoplastic material, preferably in polyacetal.

More precisely, preferably, at least the sole-plates 50 are made with the aid of a molybdenum based polyacetal.

According to an embodiment given by way of non-limitative example of the present invention:

the support plate 10 has a length referenced a in FIG. 2 of the order of 42 cm, a width referenced b in FIG. 2 of the order of 30 cm, a relative inclination between the faces 14 and 15 of the transverse ribs 13 between 5° and 20° and preferably equal to 10°, the plates 50 have a width 1 of the order of 11 cm and a length of the order of 30 cm, the lower surface 59 of the sole plates 50 being provided with a pivot pin 80 situated 7 cm from the front edge, as well as a protrusion of circular contour 60 of a diameter of b 8 cm, and two protrusions 61,62 each having a length of 9.5 cm and a width of 1.5 cm, the bores 20,21 made in the support plate are spaced by 13 cm, the width of the abutment bearing 18 is 8 mm, the support plate 10 is made in thermoplastic material and more precisely in polyacetal, the sole plates 50 are made in molybdenum based polyacetal.

It should be noted that the present invention is not limited to the particular embodiments which have been described but extends to any variant within its scope.

By way of example, the lower surface of the support plate can be provided with adjustable projecting means (such as threaded systems) permitting adjustment of the amplitude of angular movement in oscillation of the support plate.

In a similar manner, the support plate can be provided with means permitting adjustment of the distance separating the auxiliary axes OA and OB, in order to adjust the amplitude of angular movement of the sole plates.

If necessary, means for elastic return to a median rest position can be associated with the sole plates. In such a case, pick-ups (such as interruptors) can be arranged on the support plate in order to visualise the passage of the sole plates in their end position.

The means for adjusting the distance separating the auxiliary axes OA and OB can be formed of bearings with separation adjustable by a threaded system.

One will note finally that thanks to the structure proposed according to the invention, in particular to the pivoting of the sole plates about the respective auxiliary axes, the position taken by the feet of the user correspond exactly to that imposed for skiing.

The device illustrated in FIG. 9 will now be described.

This device 100 has the object of permitting use of the ski training device, with the aid of any type of conventional shoe.

Thus, the device illustrated in FIG. 9 permits a large number of users using different sizes of shoes, to train with a common device.

In addition, the device illustrated in FIG. 9 permits the utilization of any type of conventional shoe avoiding the generally onerous utilization of ski boots.

The device illustrated in FIG. 9 is adapted to be fixed on the pivoting sole plates respectively associated with the aid of any appropriate known means.

Essentially, the device illustrated in FIG. 9 comprises a support board equipped with two abutments 120,131 respectively in front and behind and of adjustable separation for retaining shoes supported on the support whatever the size and form of these.

According to the illustration given in FIG. 9, the flat horizontal board 110 supports at a first end the front abutment 120.

This is comprised of a sector of a cylinder 121 with a vertical axis of which the concavity faces towards the second end of the board 110, as well as a curved small tongue 122 extending the sector of the cylinder 121 intended to extend over the front end of the shoe.

The second, rear, abutment 131 is positioned on a slide 130 displaceable in translation as illustrated by the arrow referenced T, on the board 110, in order to permit adjustment of the distance separating the two abutments 120,131.

The fixing of the slide 130 on the board 110 is effected with the aid of an elastic structure 132 fixed to the slide 130 and having a projection 133 cooperating with a ribbed track 123 provided longitudinally on the upper surface of the board 110.

The functioning of the device 100 is as follows.

Initially, a pair of devices 100 are fixed on the respective pivoting sole plates.

The shoes of the user are then placed on the boards 110 and engaged under the small tongues 122.

The slide 130 is advanced for abutting against the rear end of the associated shoe. The ribs made in the track 123 are adapted to prevent return of the slide 130.

Thus, in the case where it is necessary to increase the distance separating the two abutments 120 and 131, it is necessary to lift the elastic structure 132 for disengaging the projection 133 from the track 123.

Preferably, the board 110 is fixed on the pivoting sole plates with the aid of conventional skiing fixtures. For this, the board 110 is provided on its lower face with orifices in which penetrate plugs provided on the sole plates and the board is immobilised with the aid of a locking strap pivotally mounted on the sole plate.

The pivoting sole plates 200 illustrated in FIGS. 10 to 17 will now be described.

This device can be utilized or not in combination with a shoe support such as illustrated in FIG. 9.

One will find in FIGS. 10, 11 and 12 a flat body 252 of rectangular contour having on its upper surface 253 strengthening ribs 254,255 and 256 as well as plugs 258.

The sole plate illustrated in FIGS. 10 to 12 is noteworthy in that it does not rest directly on the support plate 10, but via the intermediary of rollers 280 rotatably carried in removable cages 290.

This arrangement permits limiting of the friction on pivoting of the sole plates 200 on the support plate 10.

Preferably, each removable cage 290 has a generally parallelepipedic contour and defines an internal chamber 291 also parallelepipedic, connecting its lower surfaces 292 and upper surfaces 293.

The opposite lateral walls 294,295. of each removable cage 290 possess an internal cylindrical bore 296 rotatably receiving a pivot pin 285 rotatably supporting the rollers 280.

The cages 290 are advantageously fixed in a removable manner in the structures 210 provided on the sole plates 200 and defining a housing 211 complementary to the external envelope of the cages 290.

The engagement of the cages 290 on the sole plates 200 is advantageously effected from below.

The cages 290 have along the length of their free lower edge rectilinear longitudinal ribs 298 projecting outwards which come into abutment against the complementary abutment surfaces 212 defined by the structures 210.

The holding in position of the cages 290 on the structures 210 is obtained with the aid of elastic projections provided in the neighbourhood of the free upper edge of the lateral longitudinal walls of the cages 290.

On engagement of a cage 290 in a structure 210, the projections 299 move back by elastic deformation of the lateral longitudinal walls of the cage.

These retake their position since the projections 299 pass through the structures 210.

When a roller 280 is worn, it suffices for changing it to draw the associated cage 290 deforming, inwards, the mentioned projections 299.

It should be noted that the position of bores 296,297 and the diameter of the rollers 280 is adapted such that the rollers 280 project downwards with respect to the cages 290 for avoiding any direct contact between the pivoting sole plates 200 and the associated support plate 10.

In use, the axes X—X of the rollers 280 extend radially with respect to the axes O—O of pivoting of the sole plates.

In an advantageous manner, the fixing of the shoes engaged on the plugs 258 can be effected with the aid of a hoop (not shown in the Figures) having a hook at each of its ends, gripping tapered structures 220 arranged at the forward end of the sole plates 200 on one side and the other of plugs 258.

I claim:

1. A ski training device comprising:

a support plate, oscillating about a longitudinal principal axis of symmetry, said support plate formed of a body having a flat upper surface and a lower surface composed of two relatively inclined planes delimiting a principal longitudinal pivot bearing about said longitudinal principal axis at the vicinity of their junction, and two sole plates for the feet of the user, said sole plates being pivotally carried on said support plate, respectively on one side and the other of a plane of symmetry passing through the principal pivot axis of said support plate, about respective auxiliary axes, generally parallel to each other and perpendicular to the upper surface of said support plate, so that alternating pivoting of said sole plates about their respective auxiliary axes, brought about by the user, is accompanied by an alternating rocking of said support plate about the associted principal axis.

2. A ski training device according to claim 1, wherein the auxiliary axes are longitudinally eccentric of said respectively associated sole plates.

3. A ski training device according to claim 1, wherein the auxiliary axes are provided in the region of the front end of said sole plates.

4. A ski training device according to claim 1, wherein the auxiliary axes are situated at mid-width of said respectively associated sole plates, and the width of each said sole plate is less than the distance separating the auxiliary axes.

5. A ski training device according to claim 1, wherein each said sole plate is provided with a shoe.

6. A ski training device according to claim 1, including a pivot pin fixed to each said sole plate and engaged in a complementary bore arranged in said support plate for securing said sole plate on said support plate by elastic engagement.

7. A ski training device according to claim 1, wherein said support plate comprises:

a generally flat upper web and, transverse ribs supporting said web and presenting two relatively inclined edged delimiting said longitudinal principal axis in the vicinity of their junction.

8. A ski training device according to claim 1, wherein each sole plate comprises:

a generally flat body, and a plurality of protrusions provided on the lower surface of said body and intended to slide on said support plate on alternating pivot movements of said sole plates, said protrusions limiting the contact surface area between said sole plates and said support plate.

9. A ski training device according to claim 1, wherein said device is of thermoplastic material.

10. A ski training device according to claim 9, wherein said thermoplastic material is polyacetal.

11. A ski training device according to claim 10, wherein said polyacetal is at least partially molybdenum based.

12. A ski training device according to claim 1, wherein the angular oscillating movement of the support plate is between 5° and 20°.

13. A ski training device according to claim 1, wherein the angular movement of each said sole plate is between 30° and 80°.

14. A ski training device according to claim 1, wherein said pivot bearing is a ridge.

15. A ski training device according to claim 1, wherein said pivot bearing is a plane generally parallel to the upper surface of said support plate.

16. A ski training device according to claim 1, wherein said pivot bearing is a rounded convex surface.

17. A ski training device according to claim 1, wherein each said sole plate supportingly comprises two abutments for a shoe, the separation of said abutments being adjustable and relatively fixable by a ratchet mechanism.

18. A ski training device according to claim 1, including rollers rotatably carried in removable cages supported in each said sole plate for bearing of said sole plate on said support plate.

* * * * *